US005836001A

United States Patent [19]

Hielkman et al.

[11] Patent Number: 5,836,001

[45] Date of Patent: Nov. 10, 1998

[54] SOLENOID HAVING MULTISTAGE PLUNGER

[75] Inventors: Jerry D. Hielkman, Franklin Park; Gary A. Sparks; David J. Treadwell, both of Crystal Lake, all of Ill.

[73] Assignee: MPC Products Corporation, Niles, Ill.

[21] Appl. No.: 925,106

[22] Filed: Sep. 8, 1997

[51] Int. Cl.[6] ..... H01F 3/00

[52] U.S. Cl. ..... 335/259; 335/264; 335/255

[58] Field of Search ..... 335/227, 232, 335/236–7, 242, 251, 255, 259, 264, 265

[56] References Cited

U.S. PATENT DOCUMENTS

| | | | |
|---|---|---|---|
| 3,665,353 | 5/1972 | Campbell | 335/258 |
| 3,890,587 | 6/1975 | Field | 335/255 |
| 4,538,129 | 8/1985 | Fisher | 335/230 |
| 5,010,312 | 4/1991 | Motykiewicz | 335/261 |

*Primary Examiner*—Lincoln Donovan
*Attorney, Agent, or Firm*—Laff WHitesel Conte & Saret, Ltd.

[57] ABSTRACT

A solenoid has a multistage telescoping plunger which together produce a single stroke. Each plunger stage has a separate air gap individually associated therewith. As the first air gap closes responsive to movement of a first telescoping plunger stage, a portion of the stator becomes magnetically saturated; however, magnetic material has moved with the first plunger stage in order to bridge the saturated position which switches the flux path to a second air gap via a second of the telescoping plunger stages. An advantage is that the solenoid has a long stroke with a high pulling force on both the initial and the final ends of a continuous stroke formed by the separate movements of the first and second plunger stages.

14 Claims, 4 Drawing Sheets

SOLENOID HAVING MULTISTAGE PLUNGER

This invention relates to solenoids and more particularly to solenoids having long stroke plungers with substantially linear pulling or pushing forces.

A solenoid is an electromagnetic device having a magnetic structure with a coil and with a plunger or armature mounted in the axial center of the coil. The plunger moves along the axis of the solenoid structure in response to an energization or deenergization of the coil. An energization of the coil generates a magnetic flux in a core structure, which in turn pulls the plunger into the solenoid. A spring generally supplies a return force to restore the plunger to its starting or rest position after the coil is deenergized. Depending upon how the plunger is connected, it may either push or pull a mechanical part as the coil is energized or deenergized. The purpose of this control over a movement of the part is to enable an automatic operation in response to an electrical signal.

Usually, the mechanical force applied by a solenoid plunger may be non-linear so that it is rather weak at one place at its motion and stronger at another place in its motion. This force differential tends to limit the length of the plunger stroke. If the stroke is too long, there may not be enough force to reliably start or complete the motion.

There are many examples of times when a long plunger stroke is demanded with a fail safe operation requirement which cannot tolerate the possibility of failure. An example of such a requirement is found in the air craft industry. For example, there are times when the throttle either cannot be applied or full throttle cannot be removed. Therefore, there is a need for a lock out latch which holds the throttle in a minimum or a maximum position until the conditions which preclude such throttle operations have subsided. Hence, electrical signals generated responsive aircraft sensors may operate or release a solenoid controlling the throttle.

One example of such control of a throttle is found in a co-pending patent application Ser. No. 08/924,963, Filed Sep. 8, 1997, entitled "BI-DIRECTIONAL, DUAL ACTING, ELECTRIC SAFETY LOCK", by Gary A. Sparks, and assigned to the assignee of this application. In this example, the solenoid should operate to lock the throttle in response to certain conditions, such as the incomplete retraction or deployment of reverse thrust doors on a jet engine. The lock should be applied to the throttle very fast. The stroke must be long enough to place a mechanical part in a locking position. Substantially the full force of the plunger should be applied throughout the stroke. Other examples of how and why such a solenoid may be required will readily occur to those skilled in the art.

Accordingly, an object of the invention is to provide a new and novel solenoid with a relatively long stroke for the size of the solenoid and with a high initial force for moving the plunger or armature. Here, an object is to achieve the longer stroke without having to apply an appreciably higher amount of power to the coil.

In keeping with an aspect of the invention, these and other objects are accomplished by a telescopic plunger which moves in two steps. A stator/coil assembly provides both a magnetomotive force and a return path for the developed magnetic flux. The outer one of the telescoping plunger stages operates during the initial part of the plunger stroke. A choke region within the stator saturates magnetically. The flux path changes and then an inner one of the telescoping plunger stages operates during a second portion of the stroke. Springs provide a return force required to move both stages of the telescoping plunger to its initial extended position. The same principle can be applied to plungers having more than two stages.

A preferred embodiment of the invention is shown in the attached drawing, in which.

Figure 6:
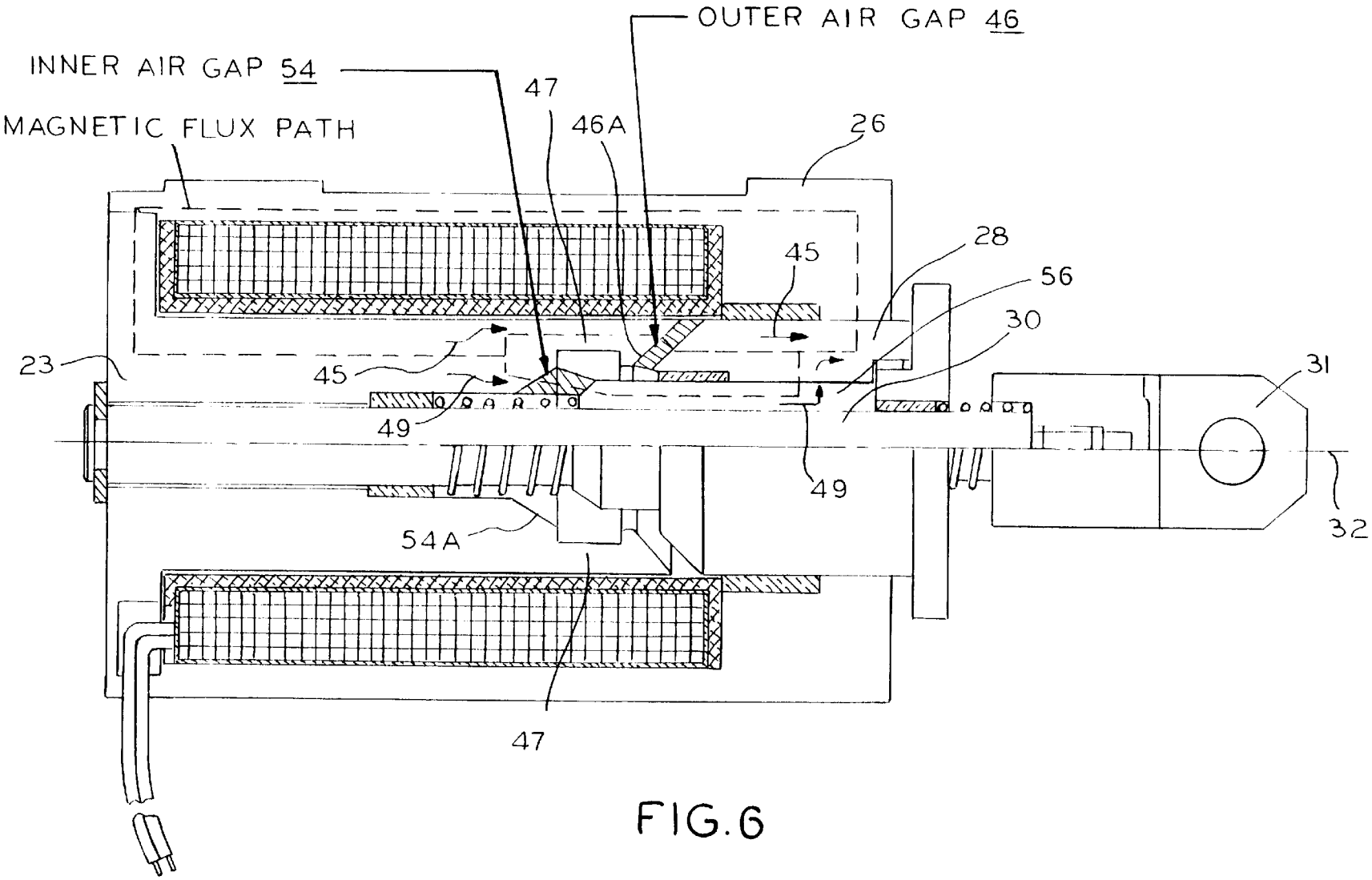

FIG. 6 helps explain the flux path of the solenoid; and

Figure 7:
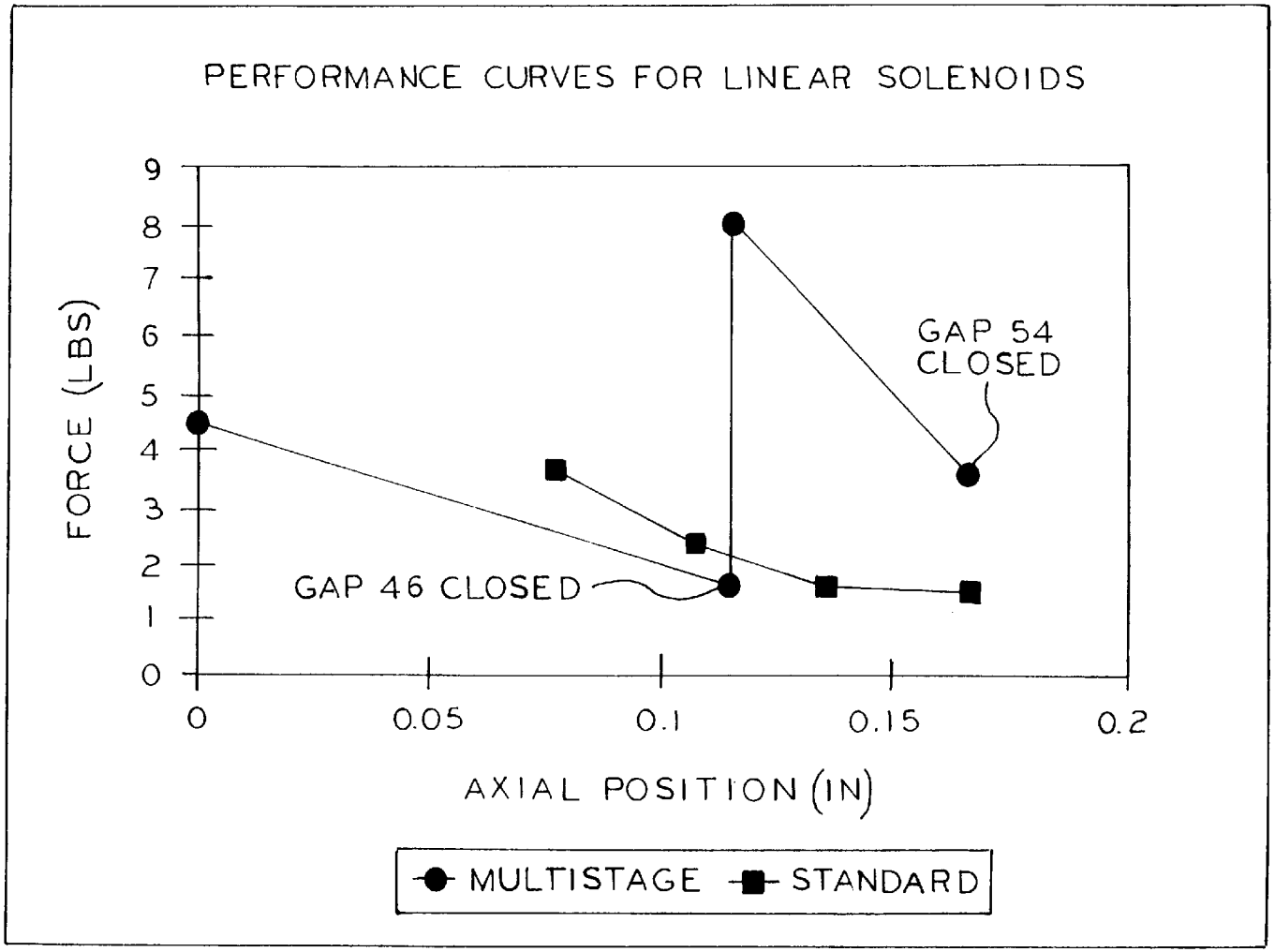

FIG. 7 is a graph which shows the performance curves for a conventional and for the inventive solenoid.

Figure 1:
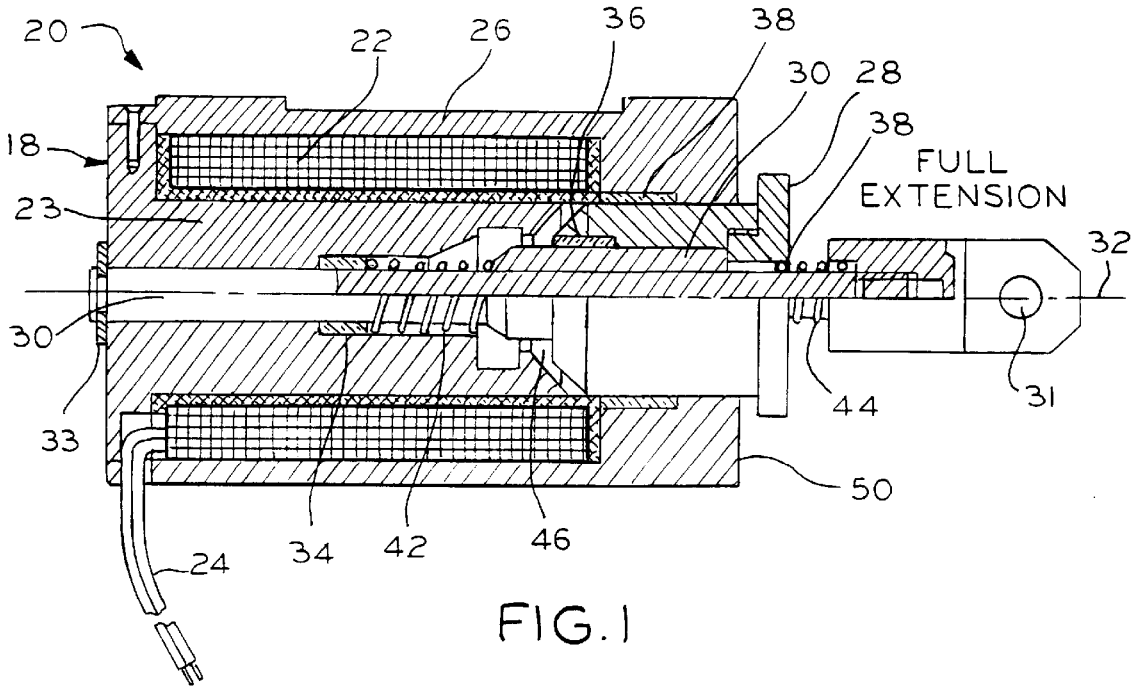
FIG. 1 is a cross-section which shows the inventive solenoid in a rest position with the two plunger stages fully extended.
Figure 2:
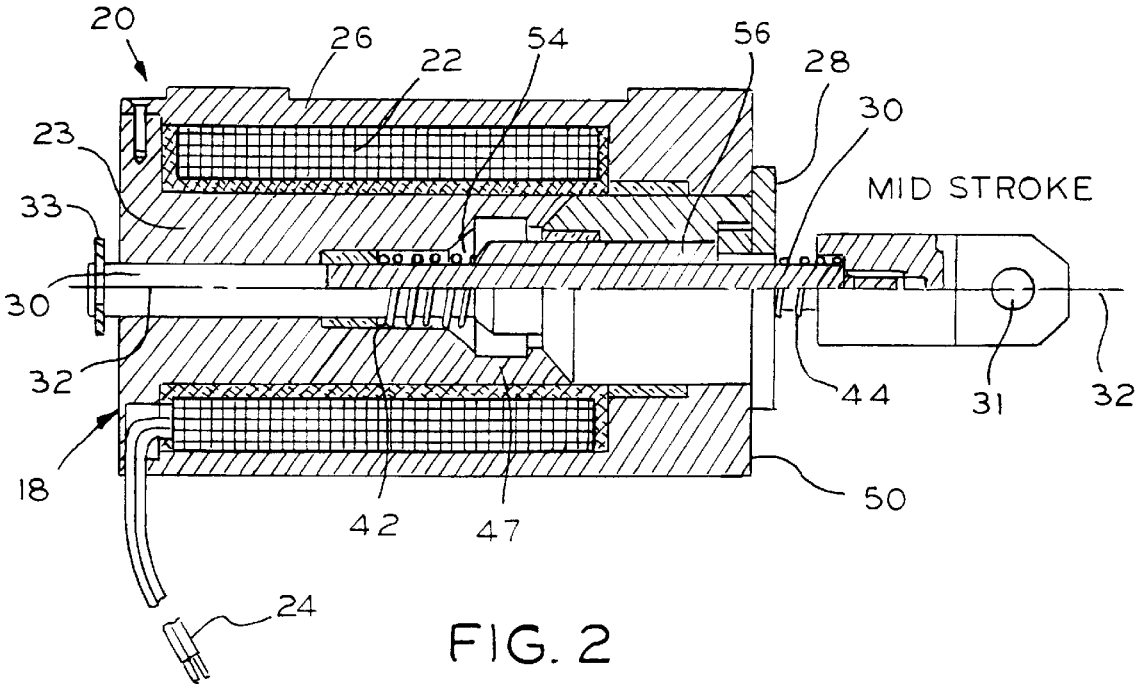
FIG. 2 is a similar cross-section which is in midstroke where the outer plunger stage is retracted and the inner plunger stage has not moved appreciably.
Figure 3:
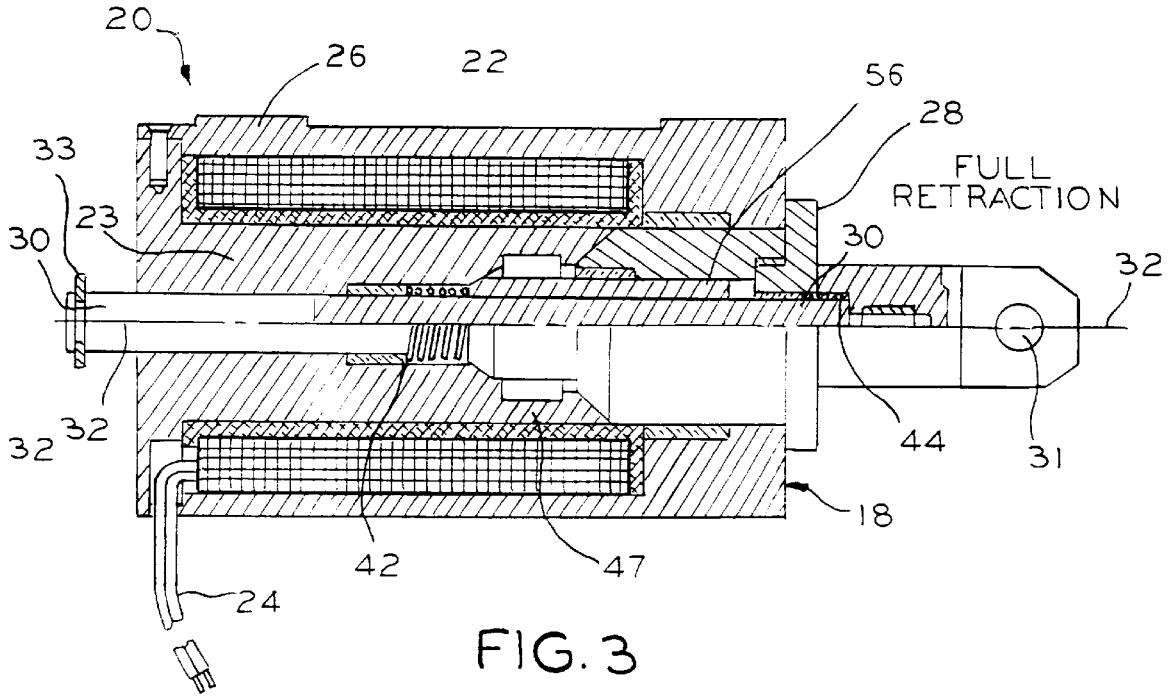
FIG. 3 is a similar cross-section where both plunger stages are fully retracted.

FIGS. 1–3 are cross sections of the inventive solenoid 20. The stator 18 is a magnetic structure having coil 22 mounted on a core 23 of magnetic material which is energized and deenergized by a voltage applied to or removed from the wires 24. The coil and core are enclosed by a housing 26 of magnetic material. A telescoping plunger is slidely mounted to move axially through the coil. The housing 26, coil 22, and core 23 form a stator assembly having a relatively thin choke area 25.

Figure 4:
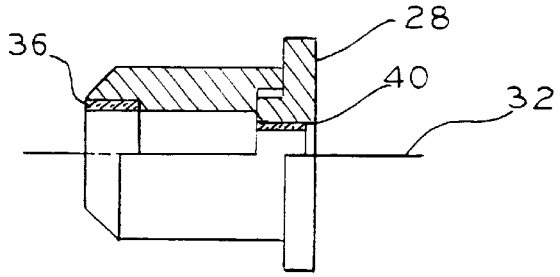
FIG. 4 is a cross-section of an outer plunger.
Figure 5:
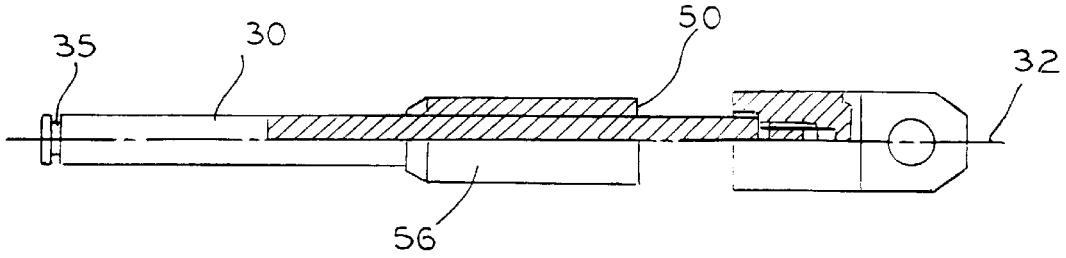
FIG. 5 is a cross-section of an inner plunger.

The telescoping plunger assembly may have any suitable number of stages or sections. It is here shown as having two stages or sections including a first stage or outer plunger 28 (FIG. 4) and a second stage or inner plunger 30 (FIG. 3). The proximal end of inner plunger 30 has a connector 31 for making a connection to an operated mechanism, such as may be associated with a throttle of an airplane. The distal end of plunger 30 has "C" spring 33 snapped thereon for preventing the plunger from sliding into the rear and out the front of this coil assembly. The "C" spring snaps into a circumferential grooves 35 (FIG. 5) around the end of plunger 30. As is conventional in U.S. drafting practice, both plungers are here shown in cross-section above a center line 32 and in outside contours below the center line. A number of bronze sleeve bearings are shown at 34–40 for enabling the two plunger stages 28, 30 to slide back and forth along an excursion route within the magnetic structures.

Two coiled springs 42, 44 normally urge the plungers to their extended rest positions as shown in FIG. 1. A first of these coiled springs 44 surrounds the inner plunger stage 30 and bears against the outer plunger stage 28, thereby urging them apart. A second of these coiled springs 42 also surrounds the inner plunger and bears against a wall in the axial bore through the stator, the wall here being bronze sleeve bearing 34. As best seen in FIGS. 2 and 3, both coiled springs 42, 44 are compressed somewhat by an initial movement of outer plunger stage 28 responsive to an energization of the coil 22. Both springs 42, 44 are fully compressed by a secondary movement primarily of the inner plunger stage 30 responsive to a continued energization of the coil 22.

In operation, a voltage is applied to wires 24 in order to energize coiled 22. Primary magnetic flux 45 (FIG. 6) appears in core 23, across outer air gap 46, and return via outer plunger stage 28 and housing 26. The outer air gap 46 closes as the outer plunger 28 is pulled in to bear against shoulder 50 (FIG. 5) on the magnetic structure. The coiled spring 42 is then compressed somewhat. Outer air gap 46 is formed between a bottom surface of plunger 28 and shoulder 46A (FIG. 6) in the bore of the magnetic structure.

The relatively thin choke part 47 of the magnetic structure saturates to redirect the effective magnetic flux through a secondary path 49 via an inner air gap 54, between the inner plunger stage 30 and the core 23. The secondary flux path 49 is through core 23, inner air gap 54, annular member 56 mounted on the inner plunger stage 30 to by-passes the saturated choke area 47, and return via outer housing 26. Inner air gap 54 is formed between the bottom of annular member 56 and a shoulder in the bore of the magnetic structure. The inner plunger stage 30 moves to close inner air gap 54, thus completing a two step plunger operation which first closes gap 46 and then gap 54. The mechanical structure attached to connector 31 is moved over a relatively long stroke.

The mechanical pulling force (marked by circles in FIG. 7) is extended by the two gap closures which exert a very strong force, as compared to the pull of convention solenoids (marked by squares), both as the initial force when primary gap 46 closes and thereafter when the secondary gap 54 closes.

By comparing the two curves in FIG. 7, it is seen that the pulling force of the multistage plunger is greater, both initially and terminally as compared to the conventional pulling forces. By an inspection of these two curves, it is seen that the ending pulling forces when gap 54 closes is about 75%, more or less, of the initial pulling force at the instant immediately before either plunger stage moved.

Both of the return springs 42 and 44 are compressed when the two plunger stages 28–30 reach their fully operated state, as shown in FIG. 3. Therefore, when the voltage is removed from wires 24 and the coil is deenergized, the springs push the inner and outer plungers 28–30 to their fully extended position (FIG. 1). The gaps 46, 54 are again open and the solenoid is at rest in its normal position awaiting its next operations.

The advantages of the invention should now be apparent. A multistage solenoid may have any suitable number of telescoping stages. A higher initial force is generated by the first stage plunger as it is retracted with an independent stroke length that is a fraction of the total stroke length. As the air gap closes on the initial stroke of outer plunger 28, magnetic saturation occurs in the adjacent choke region 47. The magnetic flux then channels from path 45 into the secondary path 49 as the inner plunger stage 30 moves to its retracted position. If there are more than two stages, the succession of stage-by-stage operations continues until all plunger stages have completed their travel using the same type of choke/flux diverting scheme. These design principle provides a total flexibility for plunger travel variations and dimensional control such that different force-to-stroke profiles can be achieved. Moreover, the reliability of the solenoid is adequate for demanding specifications such as the control of a throttle on a jet aircraft.

Those who are skilled in the art will readily perceive how to modify the invention. Therefore, the appended claims are to be construed to cover all equivalent structures which fall within the true scope and spirit of the invention.

The claimed invention is:

1. A solenoid having a multistage plunger comprising a magnetic stator assembly having a bore, a coil and a housing of magnetic material establishing a multiple flux path therein; a multistage telescoping plunger mounted for sliding motion within said bore, each of said telescoping stages comprising a plunger stage having an individually associated gap within said bore, said gap being formed between said stage and said magnetic material within said bore, a relatively thin choke section of said magnetic material individually associated with at least one of said stages, said choke section saturating responsive to an operation of a preceding stage as it moves to close to said gap; and means associated with said at least one stage for changing said flux path to be around said saturated choke section responsive to said operation of said preceding plunger stage in order to operate the next succeeding plunger stage.

2. The multistage solenoid of claim 1 wherein said magnetic material and said gaps have dimensions selected to provide a particular force-to-stroke profile for said multistage solenoid.

3. The multistage solenoid of claim 2 wherein there are two of said stages, a first of said stages comprises an outer plunger stage with a center bore and an end part which forms a first air gap with a shoulder of said magnetic material in said axial bore, an inner plunger stage which slides within said center bore of said outer plunger stage and with a second air gap formed between a bottom of said inner plunger and a second shoulder within said axial bore, said inner plunger having an annular enlargement of magnetic material which bridges said thin choke section and which forms said changed flux path including said second air gap.

4. The multistage solenoid of claim 3 and a first return spring surrounding said inner plunger and bearing against said outer plunger, and a second return spring surrounding said inner plunger and bearing against a shoulder within said axial bore.

5. A magnetic structure comprising a housing of magnetic material having a bore therein with two annular shoulders within said bore, a first of said shoulders having a diameter which is larger than a diameter of a second of said shoulder, a pair of telescoping plungers slidably mounted within said bore, a first air gap formed between a bottom of a first of said telescoping plungers and said first shoulder, a second air gap formed between a bottom of a second of said telescoping plungers and said second shoulder, a first spring between said first and second plungers for urging said two plungers apart, a second spring between one of said telescoping plungers and a support in said bore for urging said first and second plungers to an extended position, a coil surrounding said housing for generating magnetic flux therein, and a thin choke part of said housing for magnetically saturating at an end of a closing of said first gap and switching a flux path from said first to said second air gap responsive to an energization of said coil.

6. The magnetic structure of claim 5 and a connector associated with one of said telescoping plungers for moving a mechanical part responsive to motion of said plunger resulting from an energization and de-energization of said coil.

7. The magnetic structure of claim 5 wherein one of said plungers has a similar annular magnetic member thereon positioned to slide from a location clear of said thin choke part before the saturation thereof to a location spanning said thin choke part when said magnetic saturation occurs thereby providing said switched flux path which extends through said annular magnetic member and said second air gap.

8. The magnetic structure of claim 5 and a plurality of bronze sleeves along a length of said bore for providing sliding bearing surfaces between said telescoping plungers and said bore.

9. The magnetic structure of claim 5 wherein one of said plunger has an annular magnetic member thereon, positioned to slide from a location clear of said thin choke part before the saturation thereof to a location spanning said thin choke part when said magnetic saturation occurs thereby providing said switched flux path through annular magnetic member and said second air gap, a plurality of bronze sleeve bearings along a length of said bore for providing sliding bearing surfaces between said telescoping plungers and said bore, and a connector associated with one of said telescoping plungers for moving a mechanical part responsive to a motion of said plungers resulting from an energization and de-energization of said coil.

10. A solenoid having a multistage plunger, said solenoid comprising a stator having a magnetic structure with at least a pair of pole faces positioned in at least two locations along a length of a plunger excursion route, a telescoping plunger mounted to travel along said excursion route and having at least two pole faces individually associated with and forming air gaps at said pair of pole faces in said stator, each of said at least two pole faces being individually associated with a separate section of said telescoping plunger, means for generating magnetic flux in a first gap between one of said pair of pole faces and its individually associated one of said two pole faces, at least the section of said telescoping plunger having the first pole face individually associated therewith sliding in a first motion within said stator to a position which switches said magnetic flux to a second gap between the other of said pair of pole faces and its individually associated one of said two pole faces, and said section individually associated with second gap sliding in a second motion within said stator, said first and second motions being coordinated to provide a solenoid connector with a single and continuous long stroke.

11. The solenoid of claim 10 wherein said said section of said telescoping plunger which slides with said first motion has a relatively high initial pulling force which reduces linearly to a relatively low final pulling force and said section which slides with said second motion has a second initial pulling force which is higher than the relatively high pulling force and which reduces linearly to a second final pulling force which is substantially greater than said relatively low pulling force, the pulling forces which result from said first and second motions blending to provide said long stroke.

12. The solenoid of claim 11 wherein said second final pulling force is in the order of about 75% of said initial pulling force.

13. The solenoid of claim 12 wherein said second initial pulling force and said relatively low final pulling force occur simultaneously whereby said telescoping plunger moves with a single stroke devoid of said relatively low final pulling force.

14. The solenoid of claim 13 wherein said means for generating magnetic flux comprises a structure having a first flux path which passes through a region subject to magnetic saturation when said relatively low final pulling force occurs; and a section of magnetic material which is moved responsive to a movement of said plunger which supplies a second and alternative flux path bridging said region subject to said magnetic saturation, said first flux path causing said first motion and said second flux path causing said second motion.

* * * * *